United States Patent [19]

Seilstorfer et al.

[11] 4,065,303

[45] Dec. 27, 1977

[54] METHOD OF PRODUCING SHAPED OBJECTS

[75] Inventors: Helmut Seilstorfer, Munich, Germany; Willibald Wittich, deceased, late of Ottobrunn, Germany; by Messerschmitt-Bolkow-Blohm GmbH, legal representative, Munich, Germany

[73] Assignee: Messerschmitt-Bolkow-Blohm Gesellschaft mit beschrankter Haftung, Munich, Germany

[21] Appl. No.: 733,792

[22] Filed: Oct. 19, 1976

[30] Foreign Application Priority Data

Dec. 19, 1973 Germany ..... 2363141

[51] Int. Cl.[2] ..... B22F 1/00; C25D 1/00

[52] U.S. Cl. ..... 75/226; 204/281

[58] Field of Search ..... 75/226, 211, 214, 225, 75/200; 29/160.6; 204/281, 6

[56] References Cited

U.S. PATENT DOCUMENTS

| | | | |
|---|---|---|---|
| Re. 28,301 | 1/1975 | Havel | 75/226 |
| 2,538,160 | 1/1951 | Milton | 204/6 |
| 3,419,935 | 1/1969 | Pfeiler | 75/226 |
| 3,554,874 | 1/1971 | Mattia | 204/6 |
| 3,622,313 | 11/1971 | Havel | 75/226 |
| 3,723,585 | 3/1973 | Nussbaum | 204/6 |
| 3,724,050 | 4/1973 | Velten | 75/226 |
| 3,772,009 | 11/1973 | Isaksson | 75/226 |
| 3,841,870 | 10/1974 | Hamjian | 75/226 |
| 3,893,852 | 7/1975 | Bergman | 75/226 |

*Primary Examiner*—Samuel W. Engle
*Assistant Examiner*—Donald P. Walsh
*Attorney, Agent, or Firm*—Toren, McGeady and Stanger

[57] ABSTRACT

In the disclosed method of forming shaped objects by a powder-metallurgical procedure, a dummy or sample of a meltable material, such as wax, is prepared which has generally the configuration of the ultimate shaped object to be produced. A self-supporting layer is then electroformed on the dummy object to enclose the latter. The dummy object of wax or the like is then removed by melting, whereby a hollow space or cavity is formed which is defined by the layer and which corresponds to the configuration of the dummy object. Metallic powder of a type used in powder-metallurgical procedures is then filled into this space under vacuum and is subjected to hot isostatic pressing or compaction to densify and compact the powder, thereby to form the ultimate shaped object. The electroformed layer is thereafter removed and, if necessary, the object is further finish-worked in any suitable manner.

7 Claims, 5 Drawing Figures

Fig. 1
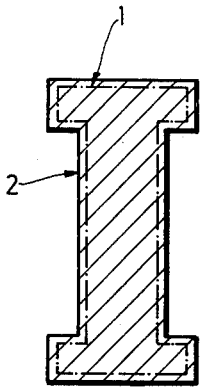
Fig. 2
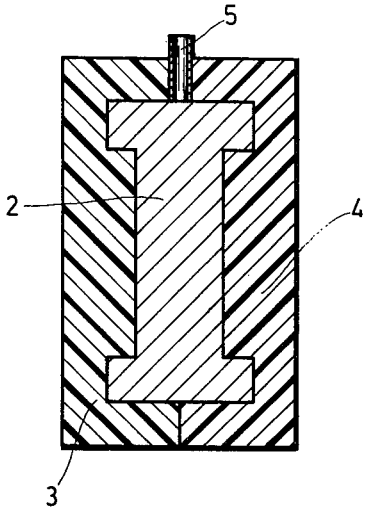
Fig. 3
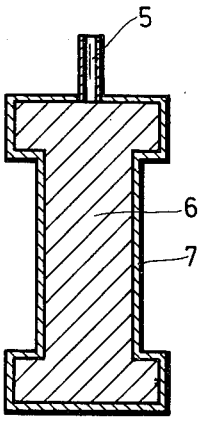
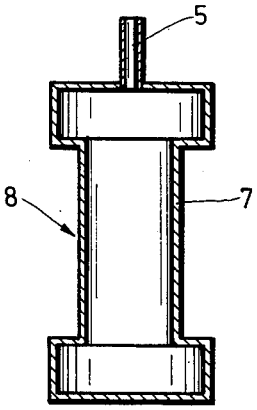
Fig. 4
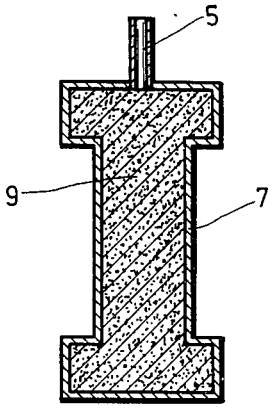
Fig. 5

METHOD OF PRODUCING SHAPED OBJECTS

FIELD OF INVENTION

This is a continuation of application Ser. No. 531,775 filed on Dec. 11, 1974 now abandoned.

The invention is directed to the production of shaped objects or elements by way of a powder-metallurgical procedure and is particularly applicable to the production of objects and elements having complicated or irregular exterior configuration.

BACKGROUND INFORMATION AND PRIOR ART

A variety of procedures has previously been proposed for the production of shapes or objects by compaction and densification of metallic powders. The term "metallic powder " as used herein is deemed to embrace metal powders proper as they are used in powder-metallurgical procedures and also includes inorganic non-metallic powders as they are, for example, disclosed in U.S. Patent 3,622,313. In this prior art patent, densified objects from metallic powders are produced in a vitreous evacuated container of a predetermined shape corresponding to the shape of the densified object ultimately desired. Generally, according to this prior art patent, a mold or container of glass or the like vitreous material is first produced, the interior cavity or space of the mold generally corresponding to the shaped object to be produced. The size or dimension of the mold cavity is such that it considers the shrinkage which may take place during the subsequent sintering or compaction procedure. The metallic powder is then filled into this mold or container under sub-atmospheric conditions whereupon the mold or container with the metal powder contained therein is subjected to hot isostatic pressing or compaction to form the ultimate object. The patent states that due to the wide difference in thermal shrinkage of the compacted metal and the surrounding glass, the glass flakes off, leaving a glass-free densified metal form.

This prior art procedure has two important drawbacks. One of the drawbacks is that it requires the use of special glass or vitreous material, the patent listing a number of representative types of glass which are suitable for the purposes of the patent. Such glass is relatively expensive. Secondly, from an economical point of view, it is generally not practical or feasible to provide molds or containers of glass for the production of shaped objects. In any event, the expenditure which is required for this purpose is generally too high to be economically sound.

SUMMARY OF THE INVENTION

It is the primary object of the invention to overcome the drawbacks and disadvantages of the prior art procedure and to provide a method for the production of shaped objects, including those of irregular or complicated configuration, by way of hot isostatic pressing or compaction of metallic powders which is less expensive and simpler than the prior art procedure.

Another object of the invention is to provide a procedure of the indicated kind which enables the production of a large number of shaped objects of identical configuration from a single master mold without resulting in the destruction of the mold.

Generally, it is an object of this invention to improve on the art of compaction and densification of metallic powders to form shaped objects or forms.

Briefly, and in accordance with the invention, a dummy object having generally the configuration of the ultimate object to be obtained is first prepared of a meltable material, such as wax or the like. A self-supporting layer is then electroformed around the dummy object, thereby to enclose the latter. The dummy object is then removed from the space defined by the layer, whereby in essence a mold is obtained whose confining walls are formed by the layer and whose cavity is the hollow space resulting from the removal of the dummy. The cavity of this mold is then filled with metallic powder under vacuum, whereupon the metallic powder is subjected to hot isostatic pressing or compaction to densify and compact the powder and to form the ultimate shape or product. The exterior layer which thus remains on the ultimate object and which corresponds to the initial electroformed layer on the dummy is then removed in any suitable manner.

In a preferred embodiment of the invention which is particularly applicable to situations in which a plurality of shapes or objects of identical configuration are to be produced, a master mold, preferably a multi-part mold, is first produced which has an interior mold cavity generally corresponding to the shape or objects to be produced. Wax or the like meltable material is then introduced into the cavity of this master mold to form a wax sample or dummy which is removed from the mold. The wax dummy is then subjected to electroforming to form an exterior enclosing layer, whereupon the wax is removed by melting and the subsequent procedure is the same as described above.

According to this embodiment of the invention, the procedural steps may thus be listed as follows:

a. First a multi-part master mold is produced having a mold cavity with a configuration generally corresponding to that of the ultimate product to be produced;

b. Dummies or patterns of wax or the like meltable material are formed within this mold cavity;

c. Galvanically formed hollow molds are produced by electroforming a layer on the wax dummies and subsequent melting of the wax, whereby a self-supporting mold is obtained which consists of the electroformed layer as defining wall and a mold cavity corresponding to the space left after the removal of the wax by melting. The electroforming of the dummy or patterns may be accomplished, for example, by nickel plating the wax dummies. Any other plating process generally used in the electroforming art is, of course, also suitable.

d. A metallic powder of the type customarily used in powder metallurgy is then filled into the cavity formed after the removal of the wax dummy, the filling preferably being effected under sub-atmospheric conditions;

e. The metal powder is then subjected to hot isostatic pressing in the mold cavity;

f. The product thus formed is then finish-worked, for example, the exterior, initially electroformed layer is removed.

It will be appreciated that the inventive procedure has many advantages, one of which is that the master mold for producing the dummy objects, of course, can be reused any number of times without requiring destruction. This is a great advantage compared to the prior art procedure of U.S. Pat. No. 3,622,313, in which the mold of glass is destroyed after each use.

Another very significant advantage of the inventive procedure is that it opens up a wider field of utilization since it permits the production of shapes or objects having interior cavities or bores. This is not feasible in the prior art procedures in which glass molds are used.

It will be appreciated that the master mold will preferably be formed with a mold cavity which is slightly larger than the size of the ultimate product in order to consider the shrinkage which may take place during the subsequent densification and compaction steps.

The various features of novelty which characterize the invention are pointed out with particularity in the claims annexed to and forming a part of this specification. For a better understanding of the invention, its operating advantages and specific objects attained by its use, reference should be had to the accompanying drawing and descriptive matter in which there are illustrated and described preferred embodiments of the invention.

IN THE DRAWINGS:

FIG. 1 is a section through a dummy object having the general configuration of the ultimate product or shape to be produced;

FIG. 2 is a sectional view through a master mold or pattern to be used in the production of dummies of the type shown in FIG. 1.

FIG. 3 shows a dummy object with an electroformed confining layer, the layer being formed by electroplating;

FIG. 4 shows a hollow mold obtained after removal of the dummy object; and

FIG. 5 shows the hollow mold of FIG. 4 after it has been filled with metal powder.

Turning now to the Figures, and in particular FIG. 1, reference numeral 2 generally indicates a dummy object of the type to be ultimately produced. This dummy is made of metal, plastic or the like suitable material and has dimensions which are slightly larger than those of the ultimate product to be produced. Thus, in order to consider shrinkage and the like phenomena taking place during the powder-metallurgical procedure, the dummy 2 is produced with an excess dimension indicated by reference numeral 1 and the dash dotted lines of FIG. 1, the interior space defined by the dash dotted lines thus corresponding to the dimension of the ultimate object.

Referring now to FIG. 2, it will be noted that this Figure shows a two-part master mold comprising the parts 3 and 4. This mold is advantageously produced by casting around the dummy or pattern 2 of FIG. 1, the Figure showing the dummy 2 as occupying the mold cavity. It will be noted that a supply pipe 5 traverses the mold 3,4 so as to gain access from the exterior into the mold cavity. This supply pipe 5 is, of course, of importance for the subsequent removal of the wax dummy and the filling of metal powder into the mold defined by the electroformed layer.

It should be appreciated that it is not necessary first to produce a dummy object of the type shown in FIG. 1 in order to produce the master mold 3,4. Thus, a master mold can be formed directly from any suitable material, such as wood, plastic or the like material which is easily worked.

After preparation of the master mold, 3,4, wax or the like meltable material is poured through supply pipe 5 into the mold cavity defined by the mold parts 3 and 4. If the mold has been formed by casting around the dummy object of FIG. 1, the latter, of course, has first to be removed. The wax or the like meltable material, upon solidification, thus forms a wax dummy which is removed from the mold by separating the parts 3 and 4. The removed wax dummy indicated by reference numeral 6 is then subjected to electroforming, for example, to nickel plating to form an electroformed or nickel layer 7 as shown in FIG. 3. It should be noted that due to the presence of the supply pipe 5, the wax dummy 6 will have a wax extension corresponding to the interior shape of the supply pipe 5 so that an electroformed layer will also form around the wax rod extending from the dummy 6 proper. After the formation of the electroformed layer, which can be accomplished in any customary galvanotechnical way, the wax dummy 6 with its enclosing electroformed layer 7, is heated to melt the wax which thus flows out through the pipe 5. In this matter, a hollow mold generally indicated by reference numeral 8 in FIG. 4 is formed, the mold consisting of the electroformed layer 7, including the extension or supply pipe 5, which acts as defining wall for the interior mold cavity which thus has been formed upon removal of the wax.

Metallic powder 9 is now supplied under subatmospheric conditions through the supply pipe 5 into the mold cavity of the hollow mold 8 as indicated in FIG. 5. The mold is then closed under vacuum and subjected to hot isostatic pressing with the metal powder 9 contained in the mold 8 whereby the ultimate shape or object is produced. The electroformed layer, to wit, for example, the nickel layer 7 which initially may have been formed in a thickness of 0.3 to 0.4 mm, may then be removed in any manner known per se, for example, by a cutting operation, by sandblasting or by chemical dissolution or the like.

It will be appreciated that the use of a master mold of the type shown in FIG. 2 is only necessary if a larger number of shapes of identical configuration is to be produced. If a single or a few products are to be prepared only, it is certainly feasible to carry out the procedure without the initial preparation of a master mold. Thus, a dummy object or shape of the type shown in FIG. 1 may be directly formed manually, for example, from wax or the like meltable material and this wax dummy is then subjected to the electroforming to form an exterior embracing layer thereon.

What is claimed is:

1. A method of forming a shaped object by compaction of metallic powder comprising:

a. forming a dummy object of a meltable material;

b. forming a mold within which said shaped object may be formed by hot isostatic pressing by electroforming on said dummy object a self-supporting layer having an outlet opening, said self-supporting layer thereby substantially enclosing said dummy object, said layer being formed of material having a melting point higher than the melting point of the material forming said dummy object:

c. removing the dummy object from within said layer by melting said dummy object at a temperature below the melting point of said layer and by discharging the melted material of said dummy object through said opening to form a hollow space substantially enclosed by said layer thereby to form said mold from said hollow layer;

d. filling said mold with metallic powder through said opening through which said melted material of said dummy object was discharged;

e. sealing said opening; and f. subjecting the metallic powder within said mold to hot isostatic pressing to densify and compact the powder to form said shaped object.

2. A method according to claim 1 wherein said filling of said mold with metallic powder through said opening is effected under vacuum conditions.

3. A method according to claim 1 wherein subsequent to step f) said layer forming said mold is removed from said object.

4. A method according to claim wherein said dummy object of a meltable material is formed in a master mold having an interior mold cavity of a configuration generally corresponding to the configuration of the dummy object.

5. A method according to claim 4 wherein said master mold within which said dummy object is formed comprises at least two mold parts, said mold being formed by casting around a pattern having a configuration generally corresponding to that of the ultimate object to be produced but having dimensions slightly in excess of the dimensions of the ultimate object thereby to consider shrinkage during the hot isostatic pressing.

6. A method for producing a mold for hot isostatic pressing of metallic powder therein comprising the steps of:

a. producing a master mold having a plurality of separable parts;

b. forming in said master mold a dummy object of meltable material;

c. forming a mold for hot isostatic pressing of metallic powder therein by electroforming a self-supporting layer having an outlet opening around said dummy object, said electroformed layer having a melting point higher than the melting point of the material from which said dummy object is formed; and d. subsequently removing said dummy object from within said layer by melting said dummy object at a temperature lower than the melting point of said layer and by discharging the melted material of said dummy object through said outlet opening to form said mold of said layer.

7. A method of forming a shaped object comprising:

a. forming a master mold having a mold cavity and a supply conduit which establishes communication between the mold cavity and the exterior;

b. pouring wax or the like meltable material through said supply conduit into said mold cvity to form a meltable dummy;

c. removing the wax dummy from the mold cavity;

d. forming a mold within which said shaped object may be formed by hot isostatic pressing by electroforming a self-supporting layer having an outlet opening around said wax dummy, said layer having a melting point higher than the melting point of said dummy;

e. removing the wax dummy from within said selfsupporting layer by melting said wax dummy at a temperature lower than the melting point of said layer and by discharging the melted material of said dummy through said opening thereby to form a hollow mold consisting of said self-supporting layer as a defining wall of an interior space conformig to the space left by the removed wax dummy;

f. filling said space under vacuum conditions with metallic powder through said opening through which said melted material of said dummy was discharged;

g. sealing said filled interior space of said hollow mold;

h. subjecting the metallic powder in said space to hot isostatic pressing to form a densified object; and i. removing said layer from said object.

* * * * *